US005882540A

United States Patent [19]

Farrington

[11] Patent Number: 5,882,540

[45] Date of Patent: Mar. 16, 1999

[54] WALL CONSTRUCTION APPARATUS AND METHODOLOGY

[76] Inventor: Albert J. Farrington, 750 Island Way, Clearwater, Fla. 34630

[21] Appl. No.: 747,560

[22] Filed: Nov. 12, 1996

[51] Int. Cl.[6] ..... E04G 11/06

[52] U.S. Cl. ..... 249/34; 249/35; 249/39; 52/274; 52/294; 52/741.14; 52/742.14; 264/35

[58] Field of Search ..... 264/35; 249/34, 249/35, 37, 38, 39, 40, 36, 33; 52/274, 294, 741.14, 742.14, 745.1, 745.09, 309.11, 127.2

[56] References Cited

U.S. PATENT DOCUMENTS

| | | | |
|---|---|---|---|
| 940,463 | 11/1909 | Kay | 249/34 |
| 1,142,887 | 6/1915 | Keenan | 249/39 X |
| 2,017,553 | 10/1935 | Troiel | 249/39 X |
| 2,116,457 | 5/1938 | Whitmarsh | 52/274 X |
| 2,251,775 | 8/1941 | Arrighini | 249/34 |
| 2,387,445 | 10/1945 | Herring | 249/33 X |
| 2,493,826 | 1/1950 | Oelfke et al. | 249/34 X |
| 2,511,829 | 6/1950 | Arrighini et al. | 249/34 X |
| 2,602,983 | 7/1952 | Troiel | 249/39 X |
| 2,658,252 | 11/1953 | Avril | 249/39 X |
| 2,787,820 | 4/1957 | Shileds et al. | 249/39 X |
| 3,995,843 | 12/1976 | Kasteler | 52/127.2 X |
| 4,314,430 | 2/1982 | Farrington | 52/206 |
| 4,393,635 | 7/1983 | Long | 52/309.11 |
| 4,426,061 | 1/1984 | Taggart | 264/35 X |
| 4,805,366 | 2/1989 | Long | 52/309.11 |
| 5,496,213 | 3/1996 | Miller | 264/35 X |
| 5,511,761 | 4/1996 | Schultz | 249/34 |

*Primary Examiner*—Robert Canfield
*Attorney, Agent, or Firm*—Lieberman & Nowak LLP

[57] ABSTRACT

A method for constricting a wall of a building includes the steps of providing a footing form to outline a horizontal dimension for the wall; pouring wall form ring material between opposing sides of the footing form and allowing the poured wall forming material to set to provide a wall base; attaching a first wall form of predetermined height to a side of the footing form to define a vertical dimension of the wall to be built; attaching a wall component structure to an inside surface of the first wall form at a desired location for the wall component on the wall; attaching a second wall form to an opposite side of the footing form a predetermined distance apart from the first wall form according to a desired width of the wall; pouring wall forming material between the first and second wall forms to form the wall, the wall forming material being poured around the wall component structure; and, allowing the wall forming material to set between the wall forms and around the wall component structure.

22 Claims, 3 Drawing Sheets

WALL CONSTRUCTION APPARATUS AND METHODOLOGY

FIELD OF INVENTION

The present invention relates generally to building construction methods and more specifically, to an improved method and apparatus for constructing walls for buildings, homes, and the like, that results in wall structures having exact dimensions, facilitates the easy and less costly placement and installation of wall components such as windows, doors, electrical outlets and air conduits, and exhibits greater durability and increased weather resistance.

BACKGROUND OF THE INVENTION

My previous U.S. Pat. No. 4,314,430 described a core building system for creating a wall structure for a house or building that included tying two wall forms together as a wall is formed by poring and filling concrete between the forms. That patent particularly taught the provision of a metal track unit secured on top of a preformed footing and having two outer tracks for receiving non-load bearing uprights for attaching wall components such as door and window forms, and an inner track for receiving a foam insulating layer. After the wall component forms are set into place, pan-type metal wall forms are placed on the outside of the two outer tracks and concrete is poured into the wall.

A limitation of this method was the fact that in order to secure window forms or door bucks or any other wall component on or in between the wall forms, both sides of the wall forms had to be set first. Moreover, after construction of the wall, lumber and the attendant carpentry was required to obtain a precise installation and setting of window frames and door bucks, often requiring techniques such as the placement of wedges and trim for making the window or door fit securely within the wall structure. This resulted in increased time and building costs. Furthermore, after a period of time, the constructed window frames and wood trim exhibited erosion from the moisture and weathering because of the lack of precision in the formation of the wall structure.

Thus, an improved method for constructing walls for a home or office building that is quick and results in a building having exact dimensions is highly desirable.

Moreover, a more precise method for constructing interior and exterior walls of a building that facilitates the quick and more precise installation of window frames, doors, electrical outlets, conduits and the like, within the walls would be highly desirable.

Furthermore, an improved method for constructing exterior walls of a building that facilitates the quick and more precise installation of window frames and door bucks, without the need for additional carpentry services after construction of the walls would be highly desirable.

It would also be highly desirable to provide a more precise method for constructing an exterior wall of a building that exhibits improved durability, increased weather resistance, and drastically reduces maintenance.

SUMMARY OF THE INVENTION

It is an object of the present invention to provide an improved method for building a wall structure for a home, office building, and the like.

It is another object of the present invention to provide an improved method for building a wall structure that facilitates the quick and precise installation of insulation, reinforcement rods, window frames, door bucks, electrical outlets, conduits and the like, within the wall.

It is still another object of the present invention to provide an improved method for building of a three layered exterior wall structure that includes the step of providing an insulating middle layer between opposing wall forms and includes the step of pouring concrete simultaneously on either side of the insulating layer between two opposing wall forms.

It is a further object of the invention to provide an exterior wall structure that, over a period of time exhibits improved durability and resistance to extreme weather conditions.

It is yet still another object of the invention to provide an improved method for building a wall structure for a home, office building, and the like, that utilizes novel upright footing forms that interlock with wall forms to result in the formation of a concrete wall having exact dimensions in length and width.

It is yet still a further object of the invention to provide an improved method for building a wall structure for a home, office building, and the like, that enables the formation of a step in the wall structure to enable the exact and permanent placement of a window without the necessity of providing wood trim and without the need for additional carpentry as necessitated by conventional window installation methods.

In order to accomplish the foregoing objects of the invention, there is provided a method for constructing a wall of a building including the steps of providing a footing form to outline a horizontal dimension for the wall; pouring wall forming material between opposing sides of the footing form and allowing the poured wall forming material to set to provide a wall base; attaching a first wall form of predetermined height to a side of the footing form to define a vertical dimension of the wall to be built; attaching a wall component structure to an inside surface of the first wall form at a desired location for the wall component on the wall; attaching a second wall form to an opposite side of the footing form a predetermined distance apart from the first wall form according to a desired width of the wall; pouring wall forming material between the first and second wall forms to form the wall, the wall forming material being poured around the wall component structure; and, allowing the wall forming material to set between the wall forms and around the wall component structure.

In another aspect of the invention, there is provided a wall construction apparatus including a footing form means for outlining a base width and lengthwise dimensions of the wall to be built and having first and second opposing sides situated a predetermined distance apart according to desired width of wall to be constructed; a first wall form for vertical placement upon a first side of the footing form means and a second wall form for vertical placement upon a second opposing side of the footing form means; means for securing respective first and second wall forms along respective opposite sides of the footing form means; and, a preformed wall component structure capable of being attached to an inner surface of said first wall form, whereby wall forming material is poured between the first and second wall forms and is set to result in the formation of a wall having flush mounted wall components in said wall.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Reference may now be had to a preferred embodiment of the wall construction method and apparatus of the invention, taken in conjunction to the accompanying drawings, in which.

DETAILED DESCRIPTION OF THE PREFERRED EMBODIMENTS

Figure 1:
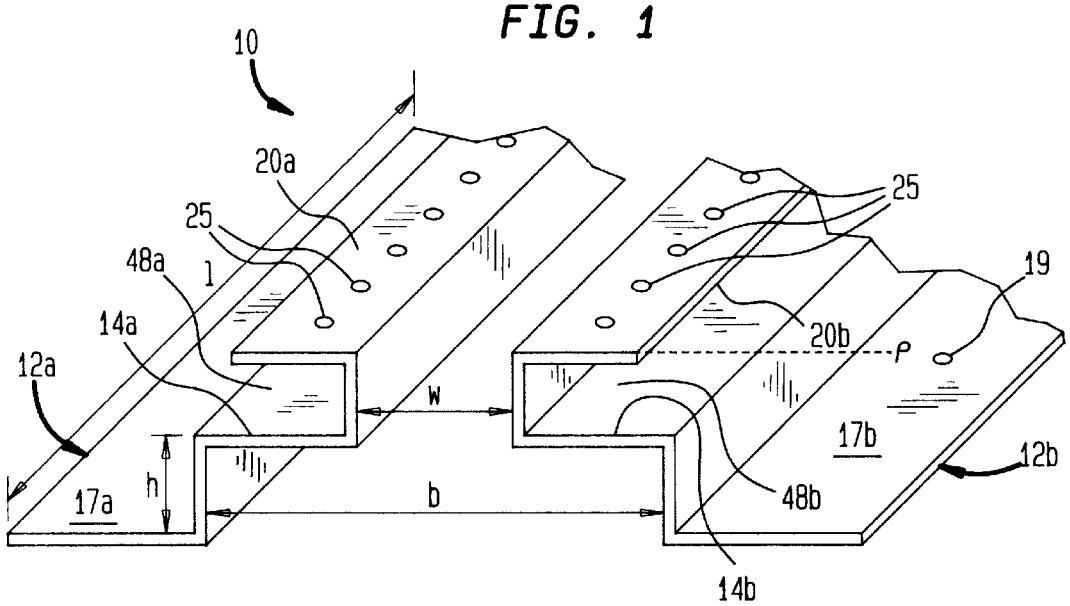
FIG. 1 illustrates a partial perspective view of a footing form used in the method for building the wall structure of the invention.

The apparatus used for constructing a wall in the improved building system of the invention includes a footing form structure 10 shown in the partial perspective view of FIG. 1. This footing form structure 10 consists of two heavy steel frame sections 12*a* and 12*b*, each of length "1" and suitable for anchored placement within the ground, in parallel, for outlining the exact base, length and width dimensions of the wall to be formed. Each steel frame portion 12*a* and 12*b* may be provided separately or, already connected in parallel by suitable connecting means (not shown) in predetermined width and lengths. For instance, the footing form 10 may be provided in eight feet sections and consist of comer footing forms (not shown) for outlining the building two-dimensionally. Furthermore, the extreme lower base portions 17*a* and 17*b* of respective footing frame sections 12*a* and 12*b* may be formed with a series of holes 19 that receive driven stakes (not shown) to anchor the footing form within the ground.

As shown in FIG. 1, steel frame portions 12*a* and 12*b* comprise respective opposing stepped portions 14*a* and 14*b*, such that, a lower base width "b", representing a lower footing width for the wall structure to be formed and an upper width or thickness "w", representing the width of the wall to be formed, are defined when the frames are situated in parallel. Additionally, as shown in FIG. 1, each stepped portion 14*a* and 14*b* is of a height "h". It is understood that the b,h and w dimensions of footing form 10 may vary in accordance with the types of walls contemplated, and will conform to any particular specifications as required by the architectural plans.

As shown in FIG. 1, the upper part of each stepped portion 14*a* and 14*b* includes an integrally formed horizontal lip or shoulder 20*a* and 20*b* overlapping the respective stepped portion 14*a* and 14*b*, and defining a space 48*a* and 48*b* therebetween. As will be explained, each shoulder portion is formed with a series of holes 25 for receiving pins from an individual wall form. Preferably, each shoulder 20*a* and 20*b* is three inches wide for accommodating the placement of a wall form of like thickness thereupon.

Figure 2:
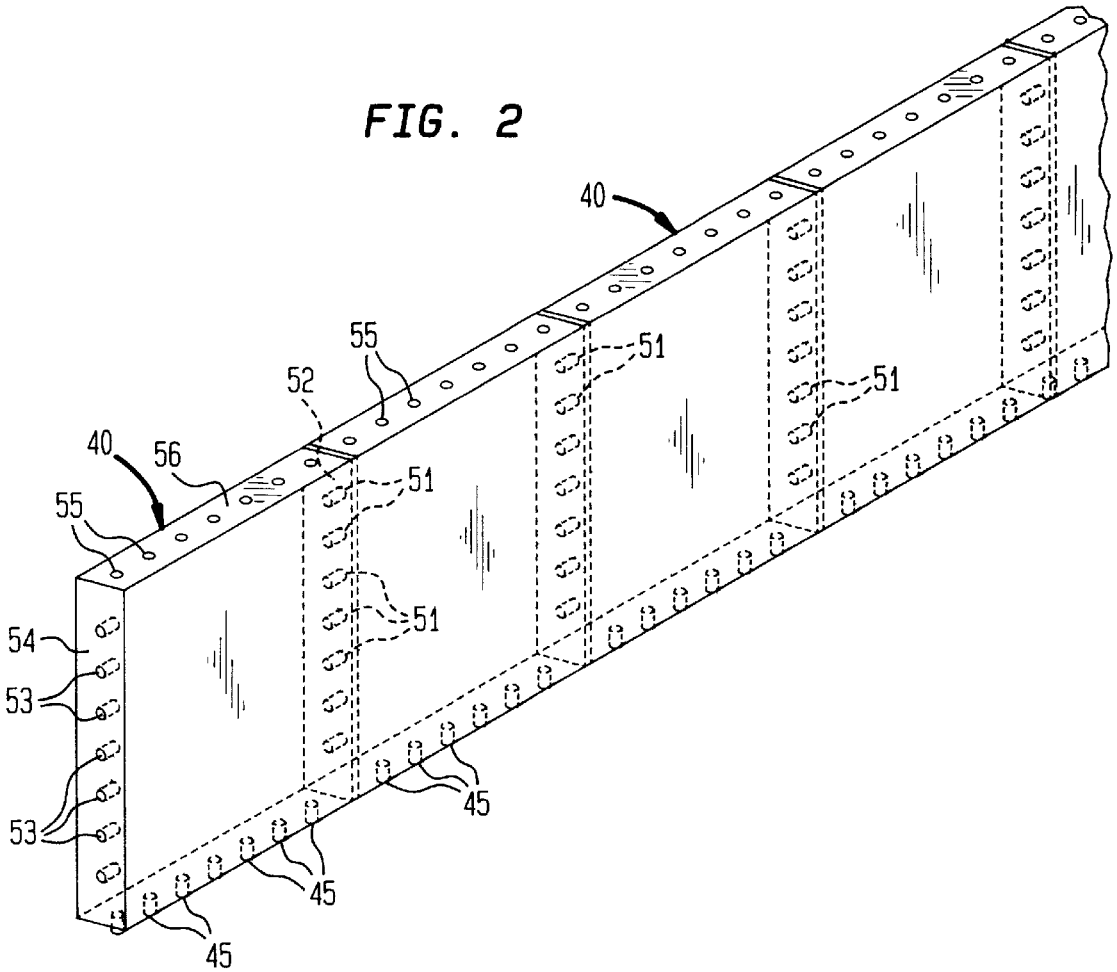
FIG. 2 illustrates a hidden perspective view of attached sectional pan-like metal wall forms used in the method for building the wall structure of the invention.

FIG. 2 illustrates a series of wall forms 40 connected together in the manner described, for placement along the shoulder portion 20*a,b* of each footing form of the building outline. Each wall form 40 is typically an individual four foot by eight foot pan-type metal structure, that is set along the shoulder portion 20*a,b* of each footing form and that is preferably the same width, e.g. three inches, as the width of the shoulder portion. Each wall form 40 includes a series of interlocking pins or bolts 45 on the horizontal bottom edge 46 that mate with a series of receiving holes 25 formed on the shoulder portion 20*a* and 20*b* of a footing form. To enable greater stability during the wall forming process, the individual pins 45 of the wall form are positioned within corresponding holes 25 of the shoulder and the wall form is locked into place on the shoulder, e.g., by nuts, in the space 48*a* and 48*b* indicated in FIG. 1, existing between the respective shoulder 20*a* and 20*b* and the stepped portion 14*a* and 14*b*. Furthermore, as shown in FIG. 2, each wall form 40 includes a series of pins 51 formed along one vertical edge 52 of the wall form 40 and a series receiving holes 53 formed along the opposite vertical edge 54 of the wall form 40. The series of pins 51 are provided to temporarily interlock with a series receiving holes 53 formed along the opposing vertical edge 54 of an adjoining wall form 40 to provide stability during wall formation. A series receiving holes 55 may optionally be provided formed along a top horizontal edge 56 of the wall form, as shown in FIG. 2, so that when a wall of extraordinary height is desired to be built, a wall form 40 having bottom pins 45 may be interlockingly set upon the top edge of an adjacent wall form 40.

The method of the invention will now be described with regard to FIGS. 3A and 3B, as follows:

First, a ditch or excavation 9 is formed in the ground 8 to accommodate the horizontal and parallel placement of footing form sections 12*a* and 12*b* of footing form 10 a predetermined distance apart according to the desired thickness of the wall to be built and according to the desired length of the wall to be built. Preferably, the dimensions of an entire building structure may be accurately laid out by connecting footing forms in tandem with suitable comer footing forms (not shown). Although not shown, a device for connecting footing form sections 12*a* and 12*b* together is provided and stakes (not shown) may be driven into the holes 19 for precise anchored placement of the footing forms in the ground. Then, a footing 15 for the wall is formed by pouring a concrete or plasticized concrete mixture between the footing form sections 12*a* and 12*b* up to the pour line P as shown in FIG. 3A and allowing the mixture to set.

Figure 3A:
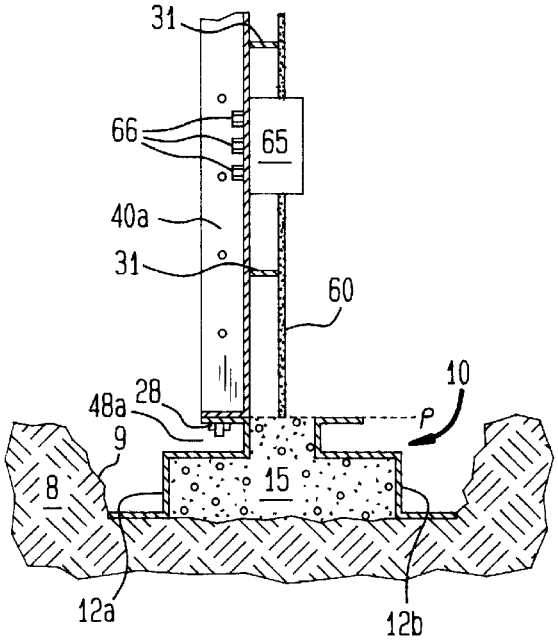
FIGS. 3*a* and 3*b* illustrates the improved wall construction method, that provides for precise installation of wall components.

In the preferred embodiment shown in FIG. 3A, a foam insulating layer 60 of predetermined thickness is attached to the wall form 40 to be set by non-load bearing metal studs 31 that surround the foam layer. If the desired wall thickness is ten inches thick, then preferably, the foam insulating layer is two inches thick. To facilitate the forming of precast openings, e.g., the setting of door bucks and window openings, and/or the placement of other wall components such as electrical outlets, air or wiring conduits, etc., the inside upright wall form e.g., 40*a*, is set in place first, on the inside footing form, e.g., 12*a*. Particularly, the bottom edge pins 45 of the wall form 40*a* that is to form the interior side of the wall are aligned and mate with the corresponding holes 25 on top of the shoulder portion 20*a* of the footing form. The wall form 40*a* is then locked in place by bolts 28 in the space 48*a* provided in the anchored footing form 10, resulting in an entirely free-standing and self-supporting wall form. The inner wall forms of the entire building to be formed may be set in this manner and in their free-standing and self-supporting state, various inner wall components, e.g., electrical outlets and wiring conduits may be set in place, precisely in a desired location, prior to closing up the wall forms by attaching the outside wall form, e.g., 40*b*. For example, a window form may be attached to the wall form 40*a* provided at three or four feet above the ground level. The foam insulating layer may be cut or pre-fabricated to accommodate the outline of the wall component form. As shown in the side view of FIG. 3A illustrating the wall formation process, an electrical wiring conduit and electrical outlet conduit 65 may be attached by means of screws, 66, to the inside of free-standing wall form 40*a*, so placed to become flush mounted in the poured concrete wall at the exact locations specified in the architectural plans.

Figure 3B:
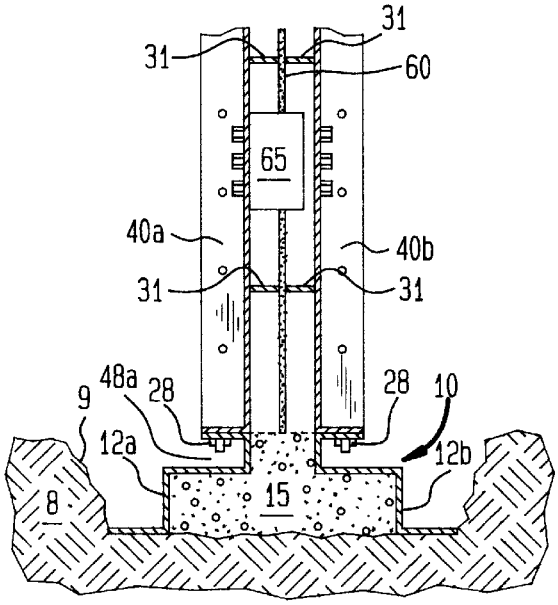

FIG. 3B illustrates the next step of the wall formation process after all wall components and wall component opening forms are attached to the first wall form 40*a* which is set on shoulder 20*a* of footing form 10 in the interlocking manner described. In FIG. 3B, the second wall form 40*b* attached to the shoulder portion 20*b* of footing form 10 by aligning the bottom edge pins 45 of the wall form 40*b* that is to form the exterior side of the wall with the corresponding holes 25 on top of the shoulder portion 20*b* and then locked in place by bolts 28 in the space 48*b* provided in the anchored footing form 10. Once this is done, a precise and stable supporting apparatus for constructing the wall is created and a concrete or plasticized concrete mixture may then be poured simultaneously on either side of the foam insulation layer 60 between the wall forms 40*a* and 40*b* to form the wall. Pouring of the concrete may be accomplished by utilizing a distribution box or a concrete pump with a double nozzle or a hoisted tremie with twin trunks, so that concrete is pumped equally into the spaces on both sides of the insulation layer 60. The concrete should be pumped simultaneously onto both sides of the insulation because the pressure of the concrete on a single side may push the insulation out of place and impair the structural integrity of the wall. It is understood that the concrete may be pumped in sections at any suitable height, such as two foot sections, to simplify the operation.

Once the poured concrete is set, the wall forms are removed with the wall components (e.g., electrical outlets, wiring conduits, etc.) flush mounted and cast in place in the completed reinforced concrete wall. The wall component forms for providing the precision window openings may be readily removed to receive the matching window components.

Figure 4:
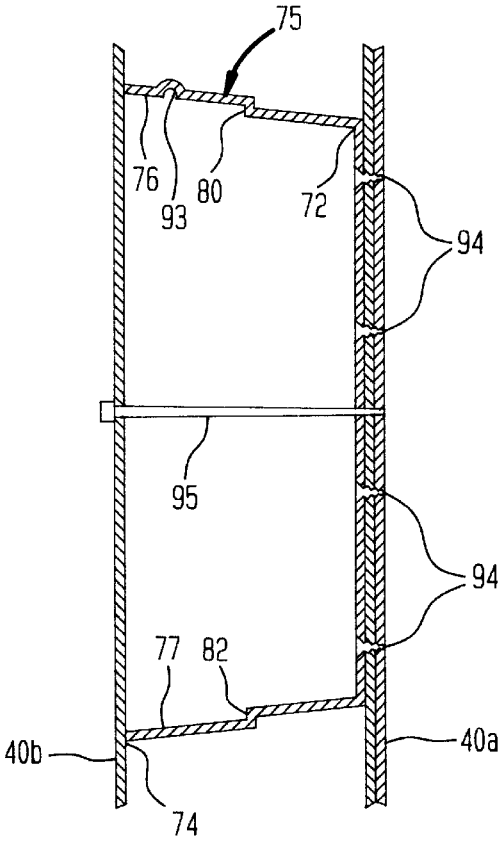
FIG. 4 illustrates a side cross-sectional view of a window form positioned between interior and exterior wall forms.

FIG. 4 illustrates a side view of a window opening form 75 shown attached to an interior wall form 40*a* and utilized for forming a precision opening in the wall for accommodating precise installation of a window (not shown). The window opening form 75 preferably is an integral, rectangular box-shaped unit having length and height dimensions substantially commensurate with dimensions of the window to be installed. It additionally has a width commensurate with the width of the wall to be formed. FIG. 4 illustrates a side view of the window component form 75 with top and bottom edges, 76 and 77, respectively, the top edge 76 being formed with a downwardly shaped step 80 and the bottom edge 77 having a corresponding upwardly shaped step 82 aligned with and directly opposite the upper step 80. It is understood that left and right edges of the window form have similar shaped notches or steps to create a continuous notch or precision rectangular indentation in the formed window opening in the wall for seating the window to be installed. The top and bottom edges 76, 77 may be straight or, as shown in FIG. 4, the upper edge may be downward tapered and the bottom edge may be tapered upward to facilitate removal of the window opening form after the wall is set. As shown in FIG. 4, the top edge 76 of wall form 75 is formed with an elongate groove 93 that will form a drip edge in the exterior wall portion of the resulting precision window opening.

The closed base portion 72 of the window form 75 is first attached to the free-standing and self-supporting inner wall form 40*a* at the exact desired location in the wall by one or more screws 94 as shown in FIG. 4. Then, when exterior wall form 40*b* is set on the footing form, a clinch bolt 95 or such similar clasp is provided to maintain the wall a predetermined distance apart. The use of the clinch bolt is crucial to keep the open end 74 of the window form 75 flush against the exterior wall form 40*b* while concrete is being poured between the wall forms and around the window form 75.

Figure 5:
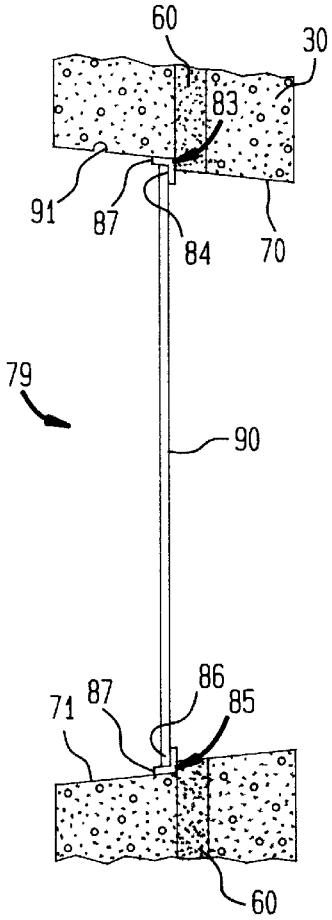
FIG. 5 illustrates a side, cross-sectional view of the formed window opening having a window installed therein.

After the concrete has been poured and set, the wall forms 40*a* and 40*b* and the window opening form 75 are removed and a precision window opening 79 in the wall for accommodating precise installation of window 90 results, as shown in FIG. 5. As shown in FIG. 5, the window form 75 enables the formation of a continuous rectangular indentation or notch, with upper notch 83 and lower notch 85 in the wall 30 shown in FIG. 5 as separating the exterior 71 and interior portions 70 of the wall 30. The window 90 is installed in the precision opening 79 by placing the window from the exterior of the wall flush against the concrete shoulders, e.g., 84 and 86, formed at the respective upper and lower notches 83 and 85, of the wall. For increased water resistance, a gasket/sealant 87 may then be applied around the exterior window edges at the concrete shoulders. Additionally, a drip edge 91 is formed in the upper exterior portion 71 of the wall by the elongate groove 93 in the window form 75. Window installation in the manner described, does not require additional trim, as required in conventional window forming methods and exhibits great durability and increased weather resistance with minimum maintenance.

Figure 6:
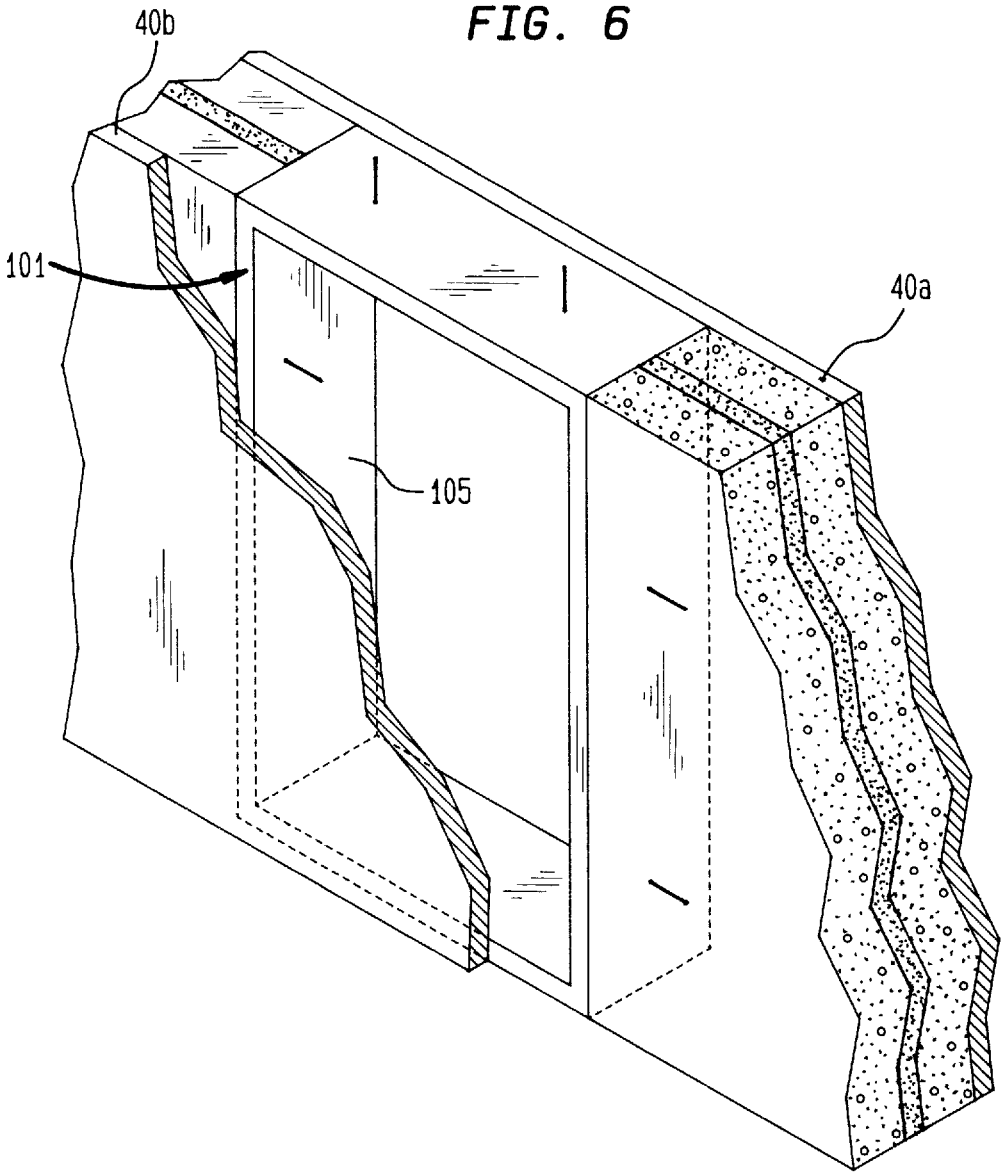
FIG. 6 illustrates a hidden perspective view of a door buck and angled door buck form installed between interior and exterior wall forms.

Door bucks may be set to form part of the wall structure in a similar manner. As shown in FIG. 6, a door buck 101 having the same thickness as the poured wall, is accurately placed and secured to the inside surface of the free standing and self-supporting inside wall form, e.g., 40*a*. Heavy lengths of angle iron forms, 105 are then bolted to the forms along the inner side of the door bucks 101 to support and maintain the structural integrity of the door buck when subjected to the heavy pressure of the poured concrete. After the wall is set, and the wall forms 40*a* and 40*b* removed, the angle iron wall form 105 is removed, resulting in a door buck accurately and permanently positioned in the reinforced concrete wall ready for doors (not shown) to be attached.

It should be understood that the preferred embodiments and examples described are for illustrative purposes only and are not to be construed as limiting the scope of the present invention which is properly delineated only in the appended claims.

I claim:

1. A wall construction apparatus including:

a footing form means constructed and arranged to outline a base width and lengthwise dimensions of the wall to be built and having first and second opposing sides situated a predetermined distance apart according to the width of wall to be constructed;

said footing form having a horizontal base portion for placement on the ground, a stepped portion comprising a first vertical wall connected to the inner edge of the base portion, an inwardly disposed horizontal wall attached to the first vertical wall, a second vertical wall connected to the inner end of said horizontal wall and an outwardly disposed shoulder portion connected to the second vertical wall of the stepped portion;

a first wall form constructed and arranged to be placed vertically upon a first side of the footing form means and a second wall form constructed and arranged to be placed vertically upon a second opposing side of the footing form means; and means for aligning and securing respective first and second wall forms to respective opposite sides of the footing form means, said aligning and securing means comprising interlocking pins and holes disposed on the bottom edge of said wall form and the shoulder portion of said footing form.

2. The wall construction apparatus as claimed in claim 1 further including a preformed wall component structure constructed and arranged to be attached to an inner surface of said first wall form, whereby wall forming material is poured between the first and second wall forms and is set to result in the formation of a wall having flush mounted wall components in said wall.

3. The wall construction apparatus as claimed in claim 2, wherein said preformed wall component structure includes a window form, said window form adapted to extend between both inner surfaces of said first and second wall forms, and being removable from said wall to obtain a window opening having precise dimensions for receiving a window therein.

4. The wall construction apparatus as claimed in claim 3, further including means for maintaining said predetermined distance between first and second wall forms at the window form as said wall forming material is set is poured between the first and second wall forms.

5. The wall construction apparatus as claimed in claim 4, wherein upper and lower edges of said window form are tapered with respect to the horizontal.

6. The wall construction apparatus as claimed in claim 4, wherein said means for maintaining the predetermined distance between first and second wall forms includes a clinch bolt.

7. The wall construction apparatus as claimed in claim 3, wherein said window form includes a continuous notched step in upper, lower, left and right sides thereof.

8. The wall construction apparatus as claimed in claim 1, further including a layer of insulating material capable of being positioned between said first and second wall forms.

9. The wall construction apparatus as claimed in claim 8, further including non-load bearing devices for maintaining said layer of insulating material substantially in position between said first and second wall forms, said wall forming material adapted to be poured simultaneously on either side of said layer of insulating material between said first and second wall forms.

10. A method for constructing a wall of a building that includes the following sequence steps:

a) providing a footing form to outline a horizontal dimension for the wall;

b) pouring wall forming material between opposing sides of said footing form and allowing said poured wall forming material to set to provide a wall base;

c) attaching a first wall form of predetermined height to a side of the footing form to define a vertical dimension of the wall to be built;

d) attaching a wall component structure to an inside surface of said first wall form at a desired location for said wall component on the wall;

e) attaching a second wall form to an opposite side of the footing form a predetermined distance apart from the first wall form according to a desired width of the wall;

f) pouring wall forming material between the first and second wall forms to form said wall, said wall forming material being poured around said wall component structure; and, g) allowing said wall forming material to set between the wall forms and around said wall component structure.

11. The method for constructing a wall of a building as claimed in claim 10, wherein the step c) attaching a first wall form to a side of the footing form includes aligning a series of pins provided on a lower edge of said first wall form with a corresponding series of holes provided on a shoulder portion of the footing form for accommodating secure receipt of said first wall form thereon.

12. The method for constructing a wall of a building as claimed in claim 10, wherein after step c) of attaching a first wall form of predetermined height to a side of the footing form, the step of providing a layer of insulating material adjacent said first wall form and providing non-load bearing devices for maintaining the layer of insulating material adjacent said first wall.

13. The method for constructing a wall of a building as claimed in claim 12, wherein the step f) of pouring wall forming material between the first and second wall forms includes simultaneously pouring said wall forming material on either side of said layer of insulating material between said first and second wall forms.

14. The improved method for constructing a wall of a building as claimed in claim 10, wherein prior to step a), the step of excavating a portion of the ground where the wall is to be built and placing said footing form at said excavated ground portion.

15. The method for constructing a wall of a building as claimed in claim 10, wherein after step g), the step of removing said first and second wall forms to obtain a wall having flush mounted wall components therein.

16. The method for constructing a wall of a building as claimed in claim 10, wherein said wall component structure includes an air duct.

17. The method for constructing a wall of a building as claimed in claim 10, wherein said wall component structure includes electrical outlets and conduits.

18. The method for constructing a wall of a building as claimed in claim 10, wherein said wall component structure includes a door buck, said method including providing an angled door buck frame along an inner surface of said door buck for maintaining structural integrity of said door buck as concrete is being poured.

19. The method for constructing a wall of a building as claimed in claim 10, wherein said wall component structure includes a window form, said window form extending between both inner surfaces of said first and second wall forms, and capable of being removed from said wall after said wall forming material is set to obtain a window opening having precise dimensions for receiving a window.

20. The method for constructing a wall of a building as claimed in claim 19, further including the step of maintaining a predetermined distance between said first and second wall forms at the window form by providing a connecting bolt between the first and second wall forms through said window form.

21. The method for constructing a wall of a building as claimed in claim 19, wherein said opening for receiving a window includes a continuous notched step in upper, lower, left and right side of the opening for receiving a window placed flush thereagainst.

22. The method for constructing a wall of a building as claimed in claim 19, wherein after obtaining said opening of precise dimensions, the step of placing a window in said opening.

* * * * *